United States Patent [19]

Brodalla et al.

[11] Patent Number: 5,064,512

[45] Date of Patent: Nov. 12, 1991

[54] PROCESS FOR DYEING ANODIZED ALUMINUM

[75] Inventors: Dieter Brodalla; Juergen Lindener; Loert de Riese-Meyer, all of Duesseldorf; Willi Wuest, Ratingen; Christine Schroeder, Duesseldorf; Willi Buchmeier; Juergen Foell, both of Duesseldorf, all of Fed. Rep. of Germany

[73] Assignee: Henkel Kommanditgesellschaft auf Aktien, Duesseldorf, Fed. Rep. of Germany

[21] Appl. No.: 382,166

[22] Filed: Jul. 19, 1989

[30] Foreign Application Priority Data

Jul. 19, 1988 [DE] Fed. Rep. of Germany ..... 3824403

[51] Int. Cl.[5] ..... C25D 11/22

[52] U.S. Cl. ..... 204/37.6; 204/42

[58] Field of Search ..... 204/37.6, 42, 54.1

[56] References Cited

U.S. PATENT DOCUMENTS

| | | | |
|---|---|---|---|
| 3,769,180 | 12/1971 | Gedde | 204/37.6 |
| 3,849,263 | 6/1970 | Gedde | 204/37.6 |
| 4,042,468 | 3/1976 | Hasegawa et al. | 204/42 |
| 4,401,525 | 11/1979 | Ruf | 204/42 |

FOREIGN PATENT DOCUMENTS

| | | |
|---|---|---|
| 2309453 | 9/1974 | Fed. Rep. of Germany . |
| 2921241 | 10/1980 | Fed. Rep. of Germany . |
| 3611055 | 6/1987 | Fed. Rep. of Germany . |
| 2384037 | 10/1978 | France . |
| 71-20568 | 6/1971 | Japan . |
| 73-101331 | 12/1973 | Japan . |
| 74-31614 | 3/1974 | Japan . |
| 76-122637 | 4/1975 | Japan . |
| 75-26066 | 5/1975 | Japan . |
| 76-147436 | 12/1976 | Japan . |
| 77-135841 | 11/1977 | Japan . |
| 77-151643 | 12/1977 | Japan . |
| 78-13583 | 5/1978 | Japan . |
| 79-97545 | 8/1979 | Japan . |
| 79-162637 | 12/1979 | Japan . |
| 55-131195 | 10/1980 | Japan . |
| 59-190389 | 4/1983 | Japan . |
| 1408859 | 10/1975 | United Kingdom . |
| 1482390 | 11/1977 | United Kingdom . |
| 2112814 | 7/1983 | United Kingdom . |

OTHER PUBLICATIONS

S. Wernick et al., Die Oberfläechenbehandlung von Aluminium, 2nd Ed., 1977, p. 364.

S. A. Pozzoli et al., Korrosionsschutz Alum., Verants. Eur. Foed Korros, Vortr. 88th, 1976, pp. 139–145.

Metal Finishing Abstracts, vol. 23 (1981), Jan./Feb., No. 1, Teddington, Middlesex, England.

*Primary Examiner*—John F. Niebling

*Assistant Examiner*—William T. Leader

*Attorney, Agent, or Firm*—Ernest G. Szoke; Wayne C. Jaeschke; Norvell E. Wisdom, Jr.

[57] ABSTRACT

Substituted diphenols, phenyl ethers containing two oxygen atoms attached to a benzene nucleus, and naphthols are more practically effective than previously known additives in stabilizing tin (II) salts, in electrolyte solutions useful for coloring anodized aluminum by electrolysis therein, against oxidation to tin(IV) by reaction with ambient oxygen. Preferred additives include 2-tert-butyl-1,4-dihydroxybenzene, methylhydroquinone, trimethylhydroquinone, 4-hydroxynaphthalene-2,7-disulfonic acid, and p-hydroxyanisole. If p-toluenesulfonic acid or napthalene sulfonic acid are also used in the electrolyte, the throwing power can be greatly improved.

20 Claims, 1 Drawing Sheet

PROCESS FOR DYEING ANODIZED ALUMINUM

FIELD OF THE INVENTION

This invention relates to a process for dyeing anodized surfaces of aluminum and aluminum alloys, wherein an oxide layer produced by means of a direct current in an acidic solution is subsequently dyed by subjecting it to an alternating current in an acidic electroyte containing tin(II) salts.

STATEMENT OF RELATED ART

Aluminum is known to be coated with a natural oxide layer, generally less than 0.1 μm thick, (Wernick, Pinner, Zurbrügg, Weiner; "Die Oberflächenbehandlung von Aluminum", 2nd Edition, Eugen Leuze Verlag, Saulgau/Württ., 1977). By chemical treatment, e.g., with chromic acid, it is possible to produce thicker modifiable oxide layers. These layers are 0.2 to 2.0 μm in thickness and form an excellent anticorrosive barrier. Furthermore, these oxide layers are preferred substrates for lacquers, varnishes, and the like, but, they are difficult to dye.

Significantly thicker oxide layers may be obtained by electrolytically oxidizing aluminum. This process is designated as anodizing, also as the Eloxal process in older terminology. The electrolyte employed for anodizing preferably is sulfuric acid, chromic acid, or phosphoric acid. Organic acids such as, e.g., oxalic, maleic, phthalic, salicylic, sulfosalicylic, sulfophthalic, tartaric or citric acids are also employed in some anodizing processes. However, sulfuric acid is most frequently used. With this process, depending on the anodizing conditions, layer thicknesses of up to 150 μm can be obtained. However, for exterior structural applications such as, e.g., facing panels or window frames, layer thicknesses of from 20 to 25 μm are sufficient.

The oxide layer consists of a relatively compact barrier layer directly adjacent to the metallic aluminum and having a thickness of up to 0.15 μm, depending on the anodizing conditions. On the outside of the barrier layer there is a porous, X-ray-amorphous cover layer.

Anodization is normally carried out in a 10 to 20% aqueous solution of sulfuric acid at a voltage of from 10 to 20 V., at the current density resulting therefrom, and at a temperature of from 18° C. to 22° C. for 15 to 60 minutes, depending on the desired layer thickness and intended use. The oxide layers thus produced have a high adsorption capacity for a multitude of various organic and inorganic dyes.

After dyeing, the dyed aluminum oxide surfaces are normally sealed by immersion in boiling water for an extended period of time or by a treatment with superheated steam. During sealing, the oxide layer on the surface is converted into a hydrate phase (A100H), so that the pores are closed due to an increase in volume. Furthermore, there are processes wherein a so called cold sealing can be accomplished, e.g., by a treatment with solutions containing $NiF_2$.

The Al oxide layers, once having been "sealed", provide good protection for the enclosed dyes and the underlying metal, because of the high mechanical strength of the sealed layers.

In a method called "coloring anodization" or the "integral process", coloring is effected concomitantly with the anodization. However, special alloys are needed for this process, so that certain alloy constituents will remain as pigments in the oxide layer formed and will produce the coloring effect. In this type of process, anodization is mostly effected in an organic acid at high voltages of more than 70 V. However, the color shades are restricted to brown, bronze, grey, and black. Although the process yields extremely lightfast and weatherresistant colorations, more recently it has been employed to a decreasing extent, because the high current requirements and high degree of bath heating required mean that it cannot be economically operated without expensive cooling equipment.

In an alternative dyeing method called "adsorptive coloring", the dyeing is achieved by the incorporation of organic dyes in the pores of the anodized layer. The colors available by this method include almost all possible colored shades as well as black, while the valuable metallic properties of the substrate are largely retained. However, this process suffers from the drawback of the low lightfastness of many organic dyes, with only a small number of such dyes being allowed for exterior structural applications by the legal regulations imposed on construction and renovation of buildings.

Processes for inorganic adsorptive coloring have also been known. They may be classified into one-bath processes and multi-bath processes. In the one-bath processes the aluminum part to be dyed is immersed in a heavy metal salt solution, whereupon as a result of hydrolysis the appropriately colored oxide or hydroxide hydrate is deposited in the pores.

In the multi-bath processes, the structural part to be dyed is immersed successively in solutions of distinct reagents, which then independently penetrate into the pores of the oxide layer and react to form the colorant pigment therein. However, such processes have not found any wide application.

All the adsorptive processes further have the inherent drawback that the coloring agents enter only the outermost layer region, so that fading of the color may occur due to abrasion.

Electrolytic dyeing processes, in which anodized aluminum can be dyed by treatment with an alternating current in heavy metal salt solutions, have been known since the mid nineteen-thirties. Mainly used in such processes are elements of the first transition series, such as Cr, Mn, Fe, Co, Ni, Cu, and most particularly Sn. Any heavy metals used are mostly used as sulfates, in solutions with a pH value of from 0.1 to 2.0 adjusted with sulfuric acid. A voltage of about 10 to 25 V. and the current density resulting therefrom are normally used. The counterelectrode may be inert, such as graphite or stainless steel, or it may be the same metal as that dissolved in the electrolyte.

In these processes, the heavy metal pigment is deposited inside the pores of the anodic oxide layer during the half-cycle of the alternating current in which aluminum is the cathode, while in the second half-cycle the aluminum layer is further built up by anodic oxidation. The heavy metal is deposited on the bottom of the pores and thereby causes the oxide layer to become colored.

The colors to be produced can be considerably varied by using various metals; for example brown-black with silver; black with cobalt; brown with nickel; red with copper; dark-gold with tellurium; red with selenium; yellow-gold with manganese; brown with zinc; dark-brown with cadmium; champagne-color, bronze to black with tin.

Among these metals, nickel salts and most recently particularly tin salts are mainly employed; these, depending on the mode of operation, yield color shades variable from gold-yellow through bright browns and bronzes to dark brown and black.

However, one problem occurring in coloring using tin electrolytes is the tendency of tin to be readily oxidized. This may cause precipitates of basic tin(IV) oxide hydrates (stannic acid) to be formed rapidly during use, and sometimes even during storage. Aqueous tin(II) sulfate solutions are known to be capable of being oxidized to form tin(IV) compounds the oxygen of the air. Such oxidation is very undesirable for coloring anodized aluminum in tin electrolytes, because on the one hand it interferes with the course of the process, necessitating frequent replacement or replenishment of the solutions that have become unusable due to precipitation, and on the other hand it causes a significant increase in costs, because the tin(IV) compounds do not contribute to the color. Thus, a number of processes have been developed, which are distinguished from each other by the kind of stabilization of the sulfuric-acidic tin(II) sulfate solution that is used in the eclectrolytic dyeing of aluminum.

German Laid-Open Application [DE-]28 50 136, for example, proposes to add, to the electrolyte containing tin(II) salts, iron(II) salts with anions from the group of sulfuric acid, sulfonic acids, and amidosulfonic acids as stabilizers for the tin(II) compounds.

By far the most frequently used as tin(II) stabilizers in such electrolytic dyeing solutions are compounds of the phenol type such as phenolsulfonic acid, cresolsulfonic acid or sulfosalicylic acid (S.A. Pozzoli, F. Tegiacchi; Korros. Korrosionsschutz Alum., Veranst. Eur. Foed. Korros., Vortr. 88th 1976, 139–45; Japanese Laid-Open Applications [JP-]78 13583, 78 18483, 77 135841, 76 47436, 74 31614, 73 101331, 71 20568, 75 26066, 76 122637, 54 097545, 56 081598; British Patent [GB-]1,482,390). Also frequently employed are: sulfamic acid (amidosulfonic acid) and/or its salts, alone or in combination with other stabilizers (JP- 75 26066, 76 122637, 77 151643, 59 190 389, 54 162637; 79 039254; GB-1,482,390); polyfunctional phenols such as, e.g., the diphenols hydroquinone, pyrocatechol, and resorcinol (JP-58 113391, 57 200221; French Patent [FR-]2 384 037), as well as the triphenols phloroglucinol (JP- 58 113391), pyrogallol (S.A. Pozzoli, F. Tegiacchi; Korros. Korrosionsschutz Alum., Veranst. Eur. Foed. Korros., Vortr. 88th 1976. 139–45; JP- 58 113391; 57 200221) and gallic acid (Jp- 53 13583).

In German Patent [DE-]36 11 055 there has been described an acidic electrolyte containing Sn(II) and an additive comprising at least one soluble diphenylamine or substituted diphenylamine derivative which stabilizes the Sn(II) and yields blemish-free colorations.

Most of these compounds that stabilize tin(II) have the disadvantage that most of them are toxic and also pollute the effluents from the anodization units. The phenols employed as stabilizers are considered to be particularly polluting.

Additionally, reducing agents such as thioethers or thioalcohols (DE- 29 21 241), glucose (Hungarian Patent [HU-]34779), thiourea (JP- 57 207197), formic acid (JP-78 19150), formaldehyde (JP- 75 26066, 60 56095; FR-23 84 037), thiosulfates (Jp- 75 26066, 60 56095), hydrazine (HU- 34779; Jp- 54 162637), and boric acid (JP-59 190390, 58 213898) are known for use alone or in combination with the above mentioned stabilizers.

In some processes there are employed complexing agents such as ascorbic, citric, oxalic, lactic, malonic, maleic and/or tartaric acids (JP- 75 26066, 77 151643, 59 190389, 60 52597, 57 207197, 54 162637, 54 097545, 53 022834, 79 039254, 74 028576, 59 190390, 58 213898, 56 023299; HU- 34779; FR- 23 84 037). Complexing agents such as these, although they exhibit an excellent stabilizing effect as regards the prevention of precipitates from the dyeing baths, are generally not capable of protecting the tin(II) in dye baths from oxidation to form tin(IV) compounds. The latter will merely be bound by complexation and kept in solution, but cannot contribute to coloring. Furthermore, in dye baths containing high amounts of complexing agents, tin(IV) complexes may accumulate to such a high extent that in the subsequent sealing step the complexes are hydrolyzed in the pores of the oxide layer, forming insoluble tin(IV) compounds which may produce undesirable white deposits on the colored surfaces.

Another important problem in electrolytic dyeing is the so-called "throwing power", which measures the ability to dye anodized aluminum parts which are located at different distances from the counterelectrode to a uniform color shade. A good throwing power is particularly important when the aluminum parts to be dyed have a complicated shape including recesses or are very large, and when for economic reasons many aluminum parts are dyed at the same time in one batch and medium color shades on the parts are desired. Thus, in practical use a high throwing power is very desirable, as failure in production is more readily avoided, and in general the optical quality of the dyed aluminum parts is better. A good throwing power renders the process more economical, because a larger number of parts can be dyed in one operation.

The term throwing power is not identical with the term uniformity and needs to be carefully differentiated therefrom. Uniformity relates to dyeing with as little as possible local variation in color shade or spotting. A poor uniformity is mostly caused by contaminations such as nitrate or by process malfunctions in the anodization. A good dye electrolyte in any event must not impair the uniformity of dyeing.

A dyeing process may produce good uniformity and nevertheless have a poor throwing power, the inverse also being possible. Uniformity is in general only affected by the chemical composition of the electrolyte, whereas the throwing power also depends on electric and geometric parameters such as, for example, the shape of a workpiece or its positioning and size. For example, DE- 26 09 146 describes a process for dyeing in tin electrolytes in which the throwing power is adjusted by a particular selection of circuit and voltage.

DE- 20 25 284 teaches that merely the use of tin(II) ions increases the throwing power, and more especially so, if tartaric acid or ammonium tartrate are added for improving the conductivity. In fact, the applicants' experience has shown that the use of tin(II) ions alone is not capable of solving the problems relating to the throwing power in dyeing. The use of tartaric acid for improving the throwing power is only of low efficiency, since tartaric acid increases the conductivity only slightly. Such a minor increase in conductivity does not bring any economic benefit, because in tin(II) dyeing the current distribution is mainly determined by surface resistances, not by the conductivity of the electrolyte.

DE- 24 28 635 describes the use of a combination of tin(II) and zinc salts, with addition of sulfuric acid, boric acid, and aromatic carboxylic and sulfonic acids (sulfophthalic acid or sulfosalicylic acid). More particularly, a good throwing power is reported to be attained if the pH value is between 1 and 1.5. The adjustment of the pH value to from 1 to 1.5 is stated in this reference to be one fundamental condition for good electrolytic dyeing. Whether or not the added organic acids have an influence on the throwing power was not described. Also the attained throwing power was not quantitatively stated.

DE- 32 46 704 describes a process for electrolytic dyeing wherein a good throwing power is attained by using a special geometry in the dyeing bath. In addition, cresol- and phenolsulfonic acids, organic substances such as dextrin and/or thiourea and/or gelatin are said to ensure uniform dyeing. A drawback inherent in this process is a high capital expenditure required for the equipment needed for it.

The addition of deposition inhibitors such as dextrin, thiourea, and gelatin has only slight influence on the throwing power, as the deposition process in electrolytic dyeing is substantially different from that during tin plating. Also in this reference, no quantification of the asserted improvement in throwing power has not been given.

It is an object of the present invention to provide an improved process for electrolytic metal salt dyeing of anodized surfaces of aluminum and aluminum alloys. In one important variation of such a process, an oxide layer is first produced by means of a direct current in an acidic solution, and the layer so produced is subsequently dyed by means of an alternating current, alone or with a superimposed direct current, using an acidic electrolyte containing tin(II) salts. More particularly, it is an object of the present invention to effectively protect the tin(II) salts contained in the electrolyte from being oxidized to tin(IV) compounds, by the addition of suitable compounds which do not possess the above mentioned disadvantages.

Further objects of the present invention are to improve the throwing power in electrolytic metal salt dyeing of anodized aluminum, either alone or in combination with new compounds stabilizing the tin(II) salts, and to stabilize concentrated Sn(II) sulfate solutions, with up to 200 g/l of $Sn^{2+}$, that are useful for replenishing exhausted dye bath solutions.

DESCRIPTION OF THE INVENTION

Figure 1:
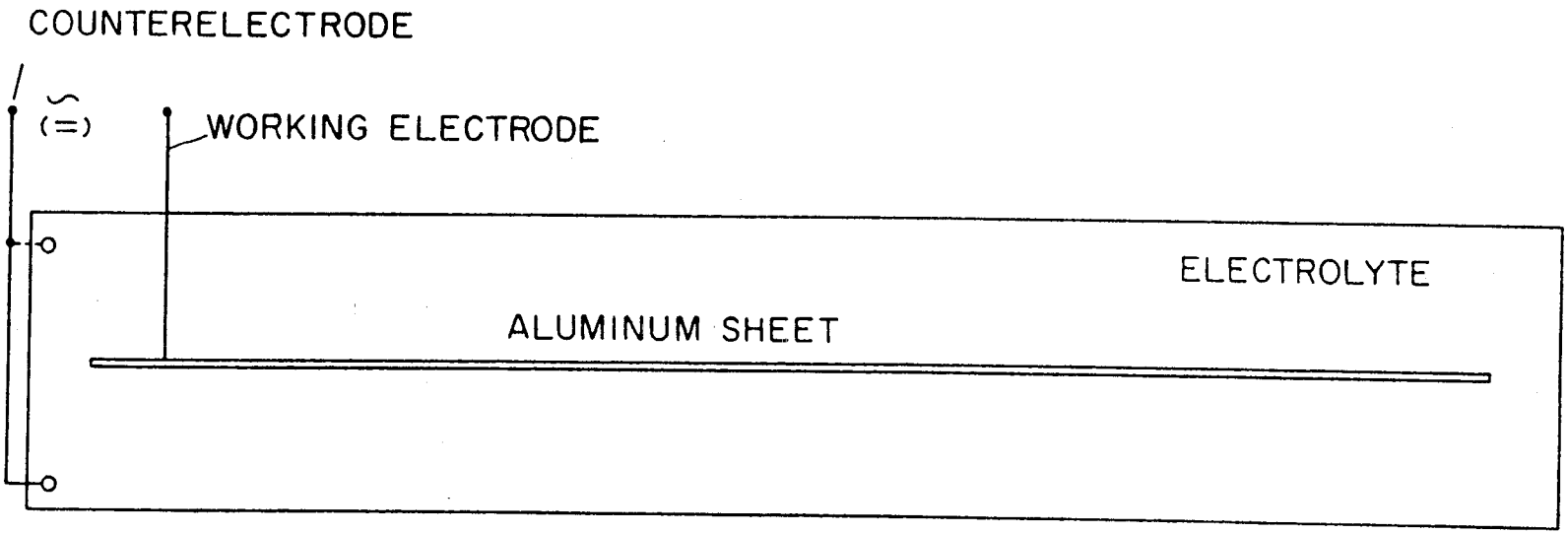
FIG. 1 shows the set-up of the dye bath.

In this description, except in the operating examples or where otherwise explicitly noted to the contrary, all numbers describing amounts of materials or conditions of reaction or use are to be understood as modified in all instances by the word "about".

A process for electrolytic metal salt dyeing of anodized surfaces of aluminum and aluminum alloys, wherein first an oxide layer is formed on the surface by means of a direct current in an acidic solution and the layer thus formed is subsequently dyed by subjecting it to an alternating current or an alternating current superimposed on a direct current in an acidic electrolyte containing tin(II) salts, is improved when the electrolyte used during the dyeing step comprises from 0.01 g/l up to the solubility limit of one or more water-soluble compounds that stabilize the tin(II) salts and have one of the general formulas (I) to (IV):

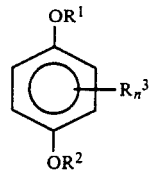
(I)

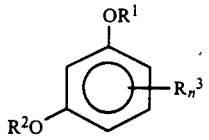
(II)

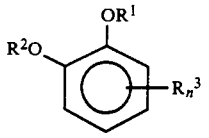
(III)

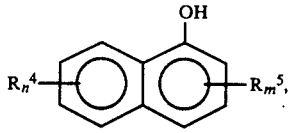
(IV)

wherein each of $R^1$ and $R^2$ independently represents hydrogen, alkyl, aryl, alkylaryl, alkylarylsulfonic acid, alkylsulfonic acid, or an alkali metal salts of either type of such a sulfonic acid, each possible type of $R^1$ and $R^2$ except hydrogen having from 1 to 22 carbon atoms; $R^3{}_n$ represents n substituents, each of which independently may be a hydrogen, alkyl, aryl, or alkylaryl group, each group having from 0 to 22 carbon atoms, and n is an integer from 1 to 4; and each of $R^4{}_n$ and $R^5{}_m$ independently represents n and m substituents respectively, each of which substituents may be a hydrogen, alkyl, aryl, alkylaryl, sulfonic acid, alkylsulfonic acid, or alkylarylsulfonic acid group, or an alkali metal salt of any of these three types of acids, each such group having from 0 to 22 carbon atoms; m is an integer from one to three; and at least one of the substituents $R^1$, $R^2$, and $R^3$ is not hydrogen.

The permissible scope of variation in the chain lengths is to be understood as limited within the range over which the compounds to be employed according to the invention have a sufficient solubility in water.

These compounds stabilizing tin(II) salts as used according to the invention, in comparison to previously known stabilizers for tin(II) compounds such as pyrogallol, do not generate any waste water with highly toxic effluents.

According to a preferred embodiment of the present invention, electrolytes which contain from 0.1 g/l to 2 g/l of the compounds stabilizing the tin(II) salts and having one of the formulas (I) to (IV) are used.

It is preferred that the tin(II) stabilizing compounds to be used according to the present invention be selected from the group consisting of 2-tert-butyl-1,4-dihydroxybenzene (tert-butylhydroquinone), methylhydroquinone, trimethylhydroquinone, 4-hydroxynaphthalene-2,7-disulfonic acid and p-hydroxyanisole.

According to another embodiment of the present invention, from 1 to 50 g/l and preferably from 5 to 25 g/l of p-toluenesulfonic acid and/or 2-naphthalenesulfonic acid can be added to any Sn (II) containing electrolytic dye bath for anodized aluminum to improve the throwing power. In an especially preferred embodiment, such additions of p-toluene sulfonic acid and/or 2-naphthalene sulfonic acid are combined with the Sn (II) stabilizing additives already noted above.

Although the use of iron(II) salts from the group of the sulfonic acids in acidic electrolytes containing tin(II) salts has basically been known (DE- 28 50 136), it was surprising that, for example, p-toluenesulfonic acid alone by itself hardly acts as a stabilizing compound for tin(II) salts, whereas upon the use of p-toluenesulfonic acid the throwing power is improved in electrolytic dyeing of anodized aluminum surfaces.

Dyeing according to this invention is preferably effected by means of a tin(II) sulfate solution which contains about 3 to 20 g/l and preferably from 7 to 16 g/l of tin and which has a pH value of from 0.35 to 0.5, corresponding to a sulfuric acid concentration of from 16 to 22 g/l at a temperature of from 14° C. to 30° C. The alternating voltage or alternating voltage superimposed on a direct voltage is preferably adjusted to from 10 to 25 V, more preferably from 15 to 18 V, the most preferable being 17 V, and it preferably has a frequency from 50–60 hertz (Hz). Within the scope of the present invention, the term "alternating voltage superimposed on a a direct voltage" is the same as a "direct current superimposed on an alternating current". The indicated value is always the value of the terminal voltage.

Dyeing generally begins at, and the voltage preferably should be selected to produce, a current density, of about 1 A/dm$^2$, which then drops, at constant voltage, to a constant value of 0.2 to 0.5 A/dm$^2$. Differing shades of dyed color, which may vary from champagne-color via various shades of bronze to black, can be obtained, depending on voltage, metal concentration in the dye bath, and immersion times.

In another embodiment, the process according to the invention utilizes an electrolyte that additionally contains from 0.1 to 10 g/l of iron, preferably in the form of iron(II) sulfate.

In still another embodiment, the process according to the invention use an electrolyte that, in addition to tin, contains salts of other heavy metals, for example of nickel, cobalt, copper, and/or zinc (cf. Wernick et al., loc. cit.). The sum of all the heavy metals present, including tin, is preferably within the range of from 3 to 20 g/l, more preferably within the range of from 7 to 16 g/l. For example, such an electrolyte may contain 4 g/l of Sn(II) ions and 6 g/l of Ni(II) ions, both in the form of sulfate salts. Such an electrolyte shows the same dyeing properties as an electrolyte which contains 10 g/l of Sn(II) only or 20 g/l of nickel of nickel only. One advantage of such compositions is the lower effluent water pollution with heavy metal salts.

FIG. 1 depicts one possible arrangement of a dye bath for evaluating the throwing power, the aluminum sheet acting as the working electrode. The other geometric factors are apparent from the Figure.

Processes according to the invention may be further appreciated from the following, non-limiting, working examples.

EXAMPLES

Example Type 1: Quick test for evaluation the storage stability of dyeing baths An aqueous electrolyte which contained 10 g/l of each of $H_2SO_4$ and $SnSO_4$ was prepared. For each subexample shown in Table 1, one liter of such solution, after dissolving in it a sufficient amount of the stabilizers shown in Table 1 to give the concentrations stated in that Table, was vigorously agitated with a magnetic stirrer at room temperature while purging with 12 liters per hour (1/h) of pure oxygen through a glass frit. The content of Sn(II) ions was continuously monitored by iodometry.

TABLE 1

Results of storage test with stabilized and unstabilized dye bath solutions (room temperature 22° C.)

| Example | Stabilizing Substance | Concentration (g/l) | Initial Concentration $SnSO_4$ (g/l) | Final Concentration $SnSO_4$ (g/l) after 4 hours | Decrease in $SnSO_4$ (%) |
|---|---|---|---|---|---|
| 1a | tert.-Butylhydroquinone | 0.2 | 12.7 | 12.7 | 0.0 |
| 1b | tert.-Butylhydroquinone | 1.0 | 13.8 | 13.8 | 0.0 |
| 1c | Methylhydroquinone | 0.2 | 17.7 | 17.7 | 0.0 |
| 1d | Methylhydroquinone | 2.0 | 17.9 | 17.9 | 0.0 |
| 1e | Trimethylhydroquinone | 1.0 | 17.1 | 17.1 | 0.0 |
| 1f | 4-Hydroxynaphthalene-2,7-disulfonic acid | 1.0 | 15.2 | 14.1 | 7.2 |
| 1g | 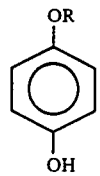 R = $CH_3$ | 0.2 | 17.7 | 17.7 | 0.0 |
| 1h | | 2.0 | 17.4 | 17.4 | 0.0 |
| 1i | 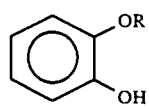 R = $(CH_2)_4SO_3Na$ | 0.2 | 18.1 | 17.7 | 2.0 |
| 1j | | 2.0 | 18.6 | 18.4 | 1.0 |

TABLE 1-continued

| | Results of storage test with stabilized and unstabilized dye bath solutions (room temperature 22° C.) | | | | |
|---|---|---|---|---|---|
| | Stabilizing Substance | Concentration (g/l) | Initial Concentration $SnSO_4$ (g/l) | Final Concentration $SnSO_4$ (g/l) after 4 hours | Decrease in $SnSO_4$ (%) |
| 1k | 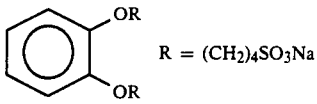 R = $(CH_2)_4SO_3Na$ | 2.0 | 18.3 | 17.9 | 2.2 |
| Comparative Examples | | | | | |
| 1l | $Fe^{2+}$ | 0.6 | 17.4 | 17.0 | 2.3 |
| | +Sulfosalicyclic acid | 1.8 | | | |
| 1m | None | — | 14.7 | 4.1 | 72.1 |
| 1n | 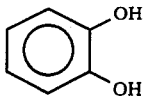 | 1.6 | 17.2 | 16.4 | 4.7 |

TABLE 2

| Comparison of Effectiveness of Various Stabilizers During Electrolysis with Two Inert Electrodes | | |
|---|---|---|
| Stabilizer | | A h Elapsed until |
| Type | Concentration, g/l | Sn(II) Concentration = 5 g/l |
| Examples | | |
| 1a | 2.0 | 1 200 |
| 1c | 2.0 | 1 160 |
| 1e | 0.5 | 930 |
| 1f | 0.5 | 1 070 |
| 1g | 2.0 | 650 |
| 1i | 2.0 | 900 |
| 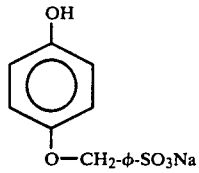 | 2.0 | 1 000 |
| 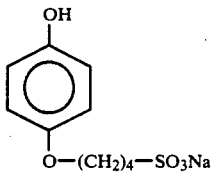 | 2.0 | 800 |
| 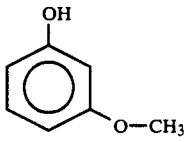 | 2.0 | 1 180 |
| Comparative Examples | | |
| 1l | 2.4 (0.6 + 1.8) | 760 |
| 1m | — | 560 |
| 1n | 2.0 | 875 |
| Hydroquinone | 2.0 | 620 |

The entries in Table 1 show the results relating to the storage stability of dye baths.

Example Type 2—Test for evaluating the stabilizing effect of additives in dyeing baths during electrolysis The subexamples set forth in Table 2 show the results of the change in Sn(II) concentrations in dye baths under electric load. For each instance shown in Table 2, an aqueous electrolyte was prepared which contained 10 g/l of Sn(II) ions, 20 g/l of $H_2SO_4$, and the amounts of a stabilizer shown in Table 2, except that compositions that were the same as one of those used in the Examples of Type 1 are noted by the same subexample number as in current flow over time was recorded by means of an A h (ampire hour) meter. The characteristic behavior of the oxide layer to be dyed was simulated by an appropriate sine wave distortion of the alternating current at a high capacitive load. The amount of Sn(II) ions oxidized by electrode reactions was determined by continuous iodometric titration of the electrolyte and by gravimetric analysis of the reductively precipitated metallic tin; the difference between the sum of these two values and the initial amount of dissolved Sn(II) represents the amount of tin oxidized. The A h value after which the Sn(II) concentration in the solution falls to or below 5 g/l due to an oxidative reaction at the electrodes is shown for each solution in Table 2.

Example Type 3—Electrolytic Dyeing

Sample sheets as shown in FIG. 1 and having the dimensions of 50 mm×500 mm×1 mm were prepared from DIN material Al 99.5 (Material No. 3.0255), conventionally pre-treated (degreased, etched, pickled, rinsed) and Table 1. Prolonged electrolysis was carried out, using two stainless steel electrodes. The integral of the anodized according to the "GS" method, i.e., a solution containing 200 g/l of $H_2SO_4$ and 10 g/l of Al, air throughput of 8 cubic meters of air per cubic meter of dyeing solution per hour ($m^3/m^3h$), a current density of 1.5 $A/dm^2$, and a dyeing solution temperature of 18° C. for 50 minutes. An anodized layer buildup of about 20 μm resulted. The sheets after this pretreatment were electrolytically dyed as described in greater detail below.

Examples 3.1 to 3.4 and comparative Examples 3 and 4

The test sheets were dyed in a special test chamber as shown in FIG. 1 for 135 seconds. The dyeing voltage was varied between 15 and 21 V. The dyeing baths contained 10 g/l of $Sn^{2+}$ and 20 g/l of $H_2SO_4$ and, as bath additives, varied amounts of p-toluenesulfonic acid (3.1 to 3.3) or 10 g/l of 2-naphthalenesulfonic acid (3.4). Analogously, in Comparative Example 3 there were 10 g/l of phenolsulfonic acid, and in Comparative Example 4 there were 10 g/l of sulfophthalic acid. It was the goal of the tests to elucidate the improvement in range dispersion (throwing power) of the Al sheets thus dyed as a result of the addition to the dye bath of p-toluenesulfonic acid and of 2-naphthalenesulfonic acid. The range dispersion resulting from the addition of 0, 10, and 20 g/l of p-toluenesulfonic acid and of 2-naphthalenesulfonic acid at dyeing voltages of 15, 18, and 21 V are shown in Table 3.

Determination of the Throwing Power

The tin distribution is first measured at 10 different locations on the test sheet in the longitudinal direction, beginning 1 cm from the margin and proceeding in increments of 5 cm.

The measurement is carried out by means of a scattered light reflectometer against the White Standard $TiO_2$ (99 %).

The amount of deposited tin at each measured point p on a sample, in mg/dm$^2$, is denoted as $[Sn]_p$ and is calculated from the % reflectivity R measured at that point according to the equation:

$$[Sn] = \frac{\left(1 - \frac{R}{100}\right)^2}{2 \cdot \frac{R}{100}} \cdot 1.75.$$

The average of the ten measurements of amount of tin made on each sample is denoted as $[Sn]_a$, and the throwing power is calculated as follows:

$$\text{Throwing power} = 100\% \cdot \left[1 - \frac{\Sigma\,|[Sn]_p - [Sn]_a|}{\Sigma\,[Sn]_p}\right]$$

TABLE 3

Variation of Throwing Power with Variation of the Dyeing Voltage and of the Amounts of Throwing Power-Improving Agent

| Dyeing Voltage (V) | Example 3.1 | 3.2 | 3.3 | 3.4 | Comp. 3 | Comp. 4 |
|---|---|---|---|---|---|---|
| | Content (g/l) of Throwing Power-Improving Agent | | | | | |
| | 0 | 10 | 20 | 10 | 10 | 10 |
| 15 | 44% | 52% | 76% | 51% | 49% | 46% |
| 18 | 56% | 74% | 90% | 71% | 60% | 59% |
| 21 | 76% | 88% | 93% | 86% | 80% | 79% |

EXAMPLE TYPE 4

These examples illustrate the improvement of the range dispersion upon the simultaneous addition of p-toluenesulfonic acid and tert-butylhydroquinone. The sheets were pre-treated and then electrolytically dyed in the same general manner as described in Example 3, but with the tin(II) stabilizing and throwing power-improving agents shown in Table 4. The results of this test series are shown in Table 4.

TABLE 4

Results of the range dispersion measurements (%) upon addition of tert-butylhydroquinone plus p-toluenesulfonic acid to the dye bath

| Dyeing Voltage (V) | Bath Additive: tert-Butylhydroquinone (2 g/l) | tert-Butylhydroquinone (2 g/l) plus p-Toluenesulfonic Acid (20 g/l) |
|---|---|---|
| 15 | 43% | 82% |
| 18 | 59% | 96% |

EXAMPLE TYPE 5

Two of these examples were performed in the same manner as Examples 3.2 and 3.3, except that the solutions used for dyeing contained 4 g/l of $Sn^{2+}$ and 6 g/l of $Ni^{2+}$ instead of 10 g/l of $Sn^{2+}$. The same results of the range dispersion measurements were obtained as in Examples 3.2 and 3.3.

Two additional examples that differed from the first two by using only 10 g/l of sulfuric acid in the dyeing bath were also performed. These produced somewhat darker colors than were obtained with 20 g/l of sulfuric acid.

What is claimed is:

1. In a process for dyeing of an anodized surface of aluminum or an aluminum alloy by subjecting said anodized surface to electrolysis, using an alternating current or an alternating current superimposed on a direct current, in an acidic electrolyte containing tin(II) salts, the improvement wherein said acidic electrolyte comprises from about 0.01 g/l to the solubility limit of at least one water-soluble tin-stabilizing compound selected from the group of compounds having one of the general formulas (I) to (IV):

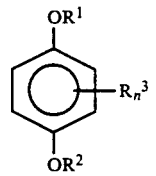

(I)

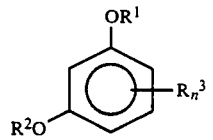

(II)

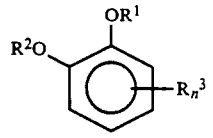

(III)

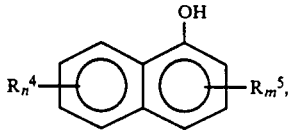

(IV)

wherein each of $R^1$ and $R^2$ independently represents hydrogen, alkyl, aryl, alkylaryl, alkylarylsulfonic acid, alkylsulfonic acid, or an alkali metal salt of either type of such a sulfonic acid, each having from 0 to 22 carbon atoms; $R^3{}_n$ represents n substituents, each of which independently may be a hydrogen, alkyl, aryl, or alkylaryl group, each group having from 0 to 22 carbon atoms, and n is an integer from 1 to 4; and each of $R^4_n$ and $R^5_m$ independently represents n and m substituents respectively, each of which substituents may be a hydrogen, alkyl, aryl, alkylaryl, sulfonic acid, alkylsulfonic acid, or alkylarylsulfonic acid group, or an alkali metal salt of any of these three types of acid groups, each such group having from 0 to 22 carbon atoms; m is an integer from one to three; and at least one of the substituents $R^1$, $R^2$, and $R^3$ is not hydrogen.

2. A process according to claim 1, wherein said acid electrolyte comprises a total of from 0.1 g/l to 2 g/l of said tin-stabilizing compounds.

3. A process according to claim 2, wherein said acid electrolyte comprises from about 7 to about 16 g/l, of tin in the form of tin(II) sulfate and has a pH value of from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

4. A process according to claim 2, wherein said acid electrolyte contains from about 5 to about 25 g/l of materials selected from the group consisting of p-toluenesulfonic acid, naphthalenesulfonic acid, and mixtures thereof.

5. A process according to claim 4, wherein said acid electrolyte comprises from about 7 to about 16 g/l, of tin in the form of tin(II) sulfate and has a pH value of from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

6. A process according to claim 2, wherein said tin-stabilizing compounds are selected from the group consisting of 2-tert-butyl-1,4-dihydroxybenzene, methylhydroquinone, trimethylhydroquinone, 4-hydroxynaphthalene-2,7-disulfonic acid, and p-hydroxyanisole.

7. A process according to claim 6 wherein said acid electrolyte comprises from about 7 to about 16 g/l, of tin in the form of tin(II) sulfate and has a pH value of from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

8. A process according to claim 6, wherein said acid electrolyte contains from about 5 to about 25 g/l of materials selected from the group consisting of p-toluenesulfonic acid and or napthalenesulfonic acid.

9. A process according to claim 8, wherein said acid electrolyte comprises from about 7 to about 16 g/l, of tin in the form of tin(II) sulfate and has a pH value of from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

10. A process according to claim 1, wherein said tin-stabilizing compounds are selected from the group consisting of 2-tert-butyl-1,4-dihydroxybenzene methylhydroquinone, trimethylhydroquinone, 4hydroxynaphthalene-2,7-disulfonic acid, and p-hydroxyanisole.

11. A process according to claim 10, wherein said acid electrolyte comprises from about 7 to about 16 g/l, of tin in the from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

12. A process according to claim 10, wherein said acid electrolyte contains from about 1 to about 50 g/l of materials selected from the group consisting of p-toluenesulfonic acid and or naphthalenesulfonic acid.

13. A process according to claim 12, wherein said acid electrolyte comprises from about 7 to about 16 g/l, of tin in the form of tin(II) sulfate and has a pH value of from about 0.35 to about 0.5 and said electrolysis is performed at a temperature of from about 14° C. to about 30° C., using an alternating voltage having a frequency of about 50 to about 60 Hz at a terminal voltage of from about 15 to about 18 V.

14. A process according to claim 1, wherein said acid electrolyte contains from about 1 to about 50 g/l of materials selected from the group consisting of p-toluenesulfonic acid, napthalenesulfonic acid, and mixtures thereof.

15. A process according to claim 14, wherein said acid electrolyte comprises from about 3 to about 20 g/l, of tin in the form of tin(II) sulfate and has a pH value of from about 0.1 to about 2 and said electrolysis is performed at a temperature of from about 14° C. to about 30° C., using an alternating voltage having a frequency of about 50 to about 60 Hz at a terminal voltage of from about 10 to about 25 V.

16. A process according to claim 1, wherein said acid electrolyte comprises from about 3 to about 20 g/l of tin in the form of tin(II) sulfate and has a pH value of from about 0.1 to about 2 and said electrolysis is performed at a temperature of from about 14° C. to about 30° C., using an alternating voltage having a frequency of about 50 to about 60 Hz at a terminal voltage of from about 10 to about 25 V.

17. A process according to claim 1, wherein said acid electrolyte additionally comprises from about 0.1 to about 10 g/l of iron as iron(II) sulfate.

18. A process according to claim wherein said acid electrolyte additionally comprises color-modifying heavy metal salts of nickel, cobalt, copper, or zinc.

19. A process according to claim 18, wherein the total amount of tin and other heavy metal salt in said acid electrolyte is from about 3 to about 20 g/l.

20. A process according to claim 19, wherein said acid electrolyte contains about 4 g/l of tin in the form of water-soluble tin(II) salt and about 6 g/l of nickel in the form of water-soluble nickel salt.

* * * * *

UNITED STATES PATENT AND TRADEMARK OFFICE

CERTIFICATE OF CORRECTION

PATENT NO. : 5,064,512

DATED : November 12, 1992

INVENTOR(S) : Brodalla et al.

It is certified that error appears in the above-identified patent and that said Letters Patent is hereby corrected as shown below:

In claim 1, column 12, line 43, "$R_n3$" should read --$R^3_n$--.

In claim 1, column 12, line 49, "$R_n3$" should read --$R^3_n$--.

In claim 1, column 12, line 55, "$R_n3$" should read --$R^3_n$--.

In claim 1, column 12, line 61, "$R_n4$" should read --$R^4_n$--.

In claim 1, column 12, line 61, "$R_m5$" should read --$R^5_m$ -.

In claim 11, column 14, line 9, after "the" insert --form of tin (II) sulfate and has a pH value of--.

In claim 18, column 14, line 50, after "claim" insert --1--.

Signed and Sealed this

Seventeenth Day of August, 1993

*Attest:*

*Attesting Officer*

Bruce Lehman

BRUCE LEHMAN

*Commissioner of Patents and Trademarks*